United States Patent [19]

Devine

[11] 4,013,990

[45] Mar. 22, 1977

[54] BELLOWS CAGING MECHANISM FOR AIRBORNE HYDROPHONE

[75] Inventor: John A. Devine, Granada Hills, Calif.

[73] Assignee: The Bendix Corporation, North Hollywood, Calif.

[22] Filed: June 30, 1975

[21] Appl. No.: 591,268

[52] U.S. Cl. ..... 340/3 T; 340/8 S; 340/8 LF

[51] Int. Cl.[2] ..... H04R 1/22; H04R 1/44

[58] Field of Search ..... 340/3 T, 8 R, 8 S, 8 LF, 340/8 PC, 10

[56] References Cited

UNITED STATES PATENTS 3,886,491 5/1975 Jonkey et al. ..... 340/8 S

*Primary Examiner*—Richard A. Farley

*Attorney, Agent, or Firm*—Robert C. Smith; William F. Thornton

[57] ABSTRACT

An airborne sonar system includes a transducer with both projecting elements and receiving elements designed for echo ranging at a moderately high frequency. Carried on the transducer housing is an additional hydrophone which is sensitive to sonar input signals at low frequency and, hence, which has a capability of responding to signals from much longer range than can the receiving elements of the echo ranging transducer. This low frequency hydrophone is sensitive to the frequency of much of the noise and vibration imparted to the transducer housing by the supporting aircraft and so, in operation, the hydrophone is suspended on a very compliant mounting consisting of a plurality of strips of light rubber tubing. To avoid damaging the hydrophone or the mounting structure, a water pressure responsive bellows is positioned adjacent to the hydrophone so that when the combined assembly is carried in air or being deployed or retrieved from the water, the bellows is expanded and serves to cage or secure the hydrophone by pressing it against part of the transducer structure. When the transducer is deployed at the desired depth in the water, the bellows is collapsed, freeing the hydrophone and leaving it suspended on the very light tubing members which serve to damp out the noise from the cable and housing. In one embodiment, the hydrophone is carried in a free-flooding chamber, and in another embodiment, the chamber is oil-filled and enclosed by a flexible rubber boot which readily transmits sonar signals as well as sea water pressure to the bellows.

8 Claims, 4 Drawing Figures

BELLOWS CAGING MECHANISM FOR AIRBORNE HYDROPHONE

BACKGROUND OF THE INVENTION

Airborne Sonar System have been in use for a number of years in which an aircraft, such as a helicopter which has a capability of hovering over a particular location, carries a sonar system including a reeling mechanism, a cable and a transducer which is reeled into the water and retrieved as needed. While in the water, the transducer radiates a desired sonar echo ranging signal, and hydrophone assemblies forming part of the transducer receive any echo signals resulting from such radiation. These signals are then processed and appear on a readout device in the helicopter itself, thereby enabling the operator to determine the direction and range of the reflecting object. In order to avoid having transducers of excessive size and weight, the operating frequency of such systems is usually fairly high, such as of the order of 10Khz. Because of the use of the comparatively high frequency, the operating range of such sonar system is limited. For some time it has been desired to combine such a system with means capable of providing a listening function capable of picking up signals from a much longer range. Such a limiting device would inherently operate at substantially lower frequencies, of the order of a few hundred Hz. Attempts to add such a listening hydrophone to the conventional airborne sonar system have encountered some severe problems, one of the most formidable of which is that when the low frequency hydrophone is attached to the housing of the airborne sonar transducer, it has imparted to it all of the vibration, hence noise, introduced down the cable from the aircraft engine itself, noise from the rotor, and other extraneous mechanical and electrical noise which is translated into the transducer housing and much of which occurs in the low frequency range at which such a hydrophone would operate. The desired low frequency sonar signals reaching the hydrophone from a substantial distance would necessarily be of comparatively small magnitudes so that they are easily covered up or distorted by the various signals emanating from the aircraft. Some of those working in the field have theorized that if such a low frequency hydrophone could be mounted on the transducer in such manner that it is comparatively unresponsive to the aircraft noise and other interference referred to above that this might solve the problem of introducing such noise into the electrical output of the hydrophone. A highly compliant mounting means for the hydrophone capable of eliminating such noise, however, would create serious problems in assembly and handling of the combined transducer structure. Most of the obvious caging arrangements for such a mounting means would require manual or electrical uncaging or releasing means or manual operations which introduce problems of their own.

SUMMARY OF THE INVENTION

A highly compliant mounting means for the low frequency hydrophone can be used if means are also employed to firmly secure the hydrophone while the transducer is being handled on board ship or otherwise manipulated in air, transported, or deployed or recovered from the water. Such a caging or securing structure should be as easily operated and foolproof as possible and preferably should not involve the need for manually operated releases or electrical solenoid switches to operate release mechanisms, etc., since such manual releases would necessarily involve remote operation with linkage and cable problems, and electrical releases are subject to either operator error or malfunction. I have determined that if such a low frequency hydrophone is suspended from a transducer structure by means of an extremely compliant flexible structure, and the weight and dimensions of said hydrophone are such that the load which it imposes on the compliant structure is very low when the transducer assembly is immersed in water, such a compliant assembly consisting of a plurality of light rubber bands, rods or tubing will carry the weight of the hydrophone and will effectively damp out noise which would otherwise be introduced into the hydrophone through the vibration from the transducer housing. At the lower end of the chamber in which said hydrophone is located, I have provided a supporting plate to which is attached a metal bellows structure. In air, this bellows is expanded and forces the hydrophone assembly firmly against the transducer structure (which may be the electronics housing assembly and related structure) at the top of its chamber. In this manner, the hydrophone is prevented from moving or being damaged even though the transducer assembly may be subject to some moderately rough handling. The chamber containing the low frequency hydrophone may be completely free-flooding and should be of such dimensions that when the assembly is in water and the bellows is collapsed, the low frequency hydrophone may accommodate up to 15 or more degrees of tilt of the transducer assembly without losing its vertical orientation. Alternatively, the hydrophone chamber may be enclosed by means of a flexible boot of an elastomeric material such as synthetic rubber and the chamber filled with an acoustically transparent liquid. Because of the very compliant mounting of the hydrophone, an additional supporting means in the form of a nylon mesh bag is used to partially carry the weight of the hydrophone in air when the bellows is removed or temporarily not in position to secure the hydrophone while the transducer is being deployed or removed from the water.

DESCRIPTION OF THE PREFERRED EMBODIMENT

Figure 1:
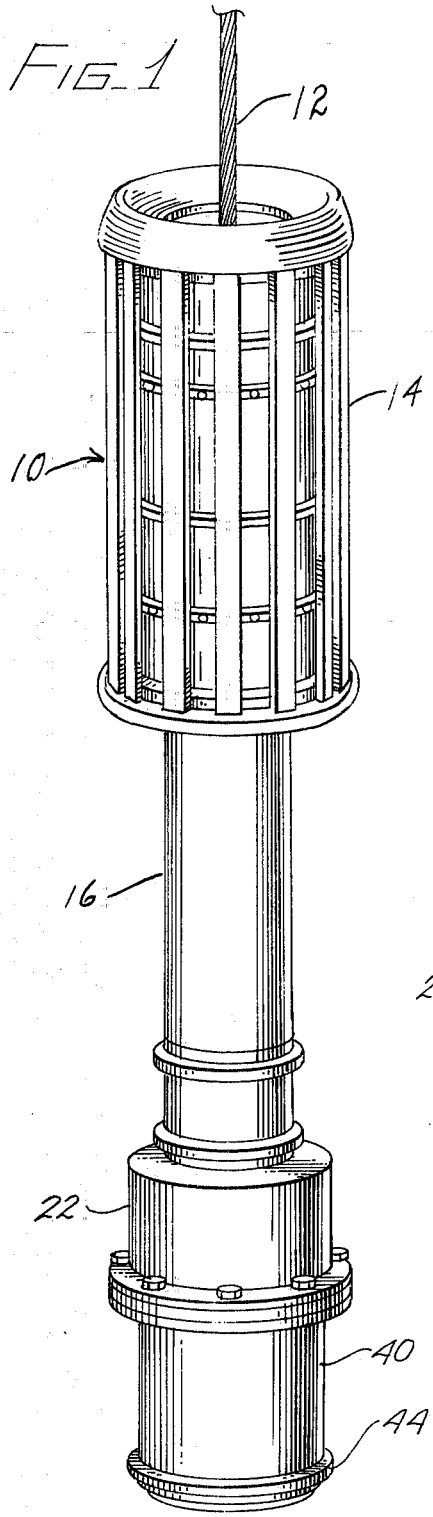
FIG. 1 is a plan view of a typical airborne sonar transducer with a low frequency hydrophone assembly attached in accordance with my invention.

FIG. 1 is a plan view of an airborne sonar transducer 10 which is normally carried by a helicopter and suspended therefrom at the end of a cable 12. Cable 12 may contain a large number of wires and a strength member in the form of a wire rope of adequate size to support the transducer which may also serve as a ground lead. The upper part 14 of the transducer consists of a plurality of receiving hydrophone units formed in linear staves. Positioned along the same axis as the hydrophone section 14 and displaced below the hydrophones is a projector section 16 which includes a plurality of annular piezoelectric projector elements. Power for echo ranging is supplied to the projector elements down the cable 12 from a power amplifier in the aircraft and the echo signals received at the hydrophone staves are supplied through the cable to a receiver in the aircraft. The system thus far described is conventional and typical of many which have been in use for several years.

Figure 2:
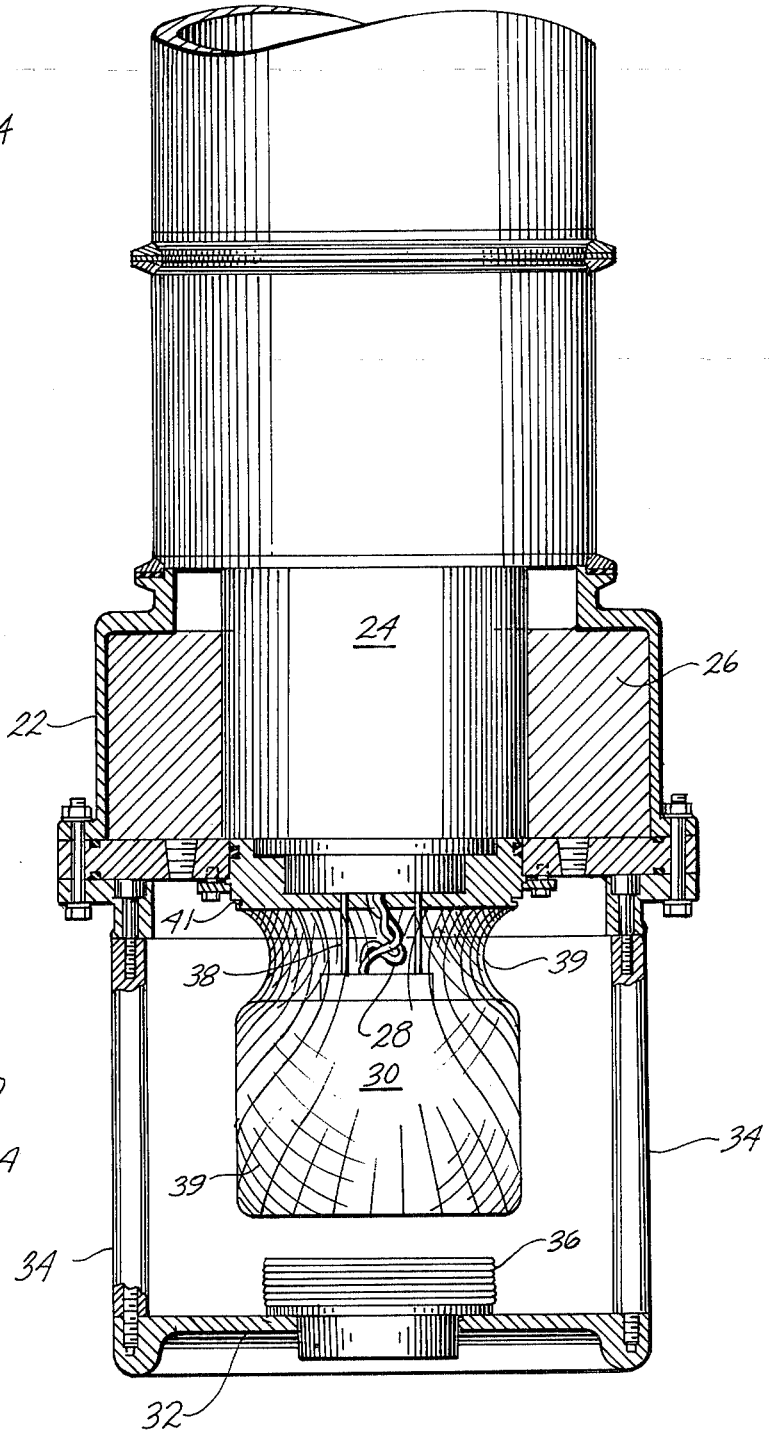
FIG. 2 is an enlarged partial view of the lower part of the assembly of FIG. 1 showing details of the one embodiment of my invention.

Since the range of operation of this system is somewhat limited, the addition of a long range, low frequency listening capability substantially enhances the utility of the combination system because the operator can then determine an approximate range and bearing of a sound source which may be at a distance which is many times the range of the basic echo ranging system. This range and bearing can then be determined with greater accuracy by reeling the transucer up into the helicopter and moving the helicopter to the general area from which the sound seemed to be emanating and deploying the transducer again. If the initial determination was reasonably close, the source should be within the range of the echo ranging system. If not, the low frequency hydrophone can again be used as before to locate the source. One, or at most two, such approximate locating steps should place the source within normal operating range of the echo ranging system. This low frequency listening capability can be supplied by means of the low frequency assembly shown generally at numeral 20 and in detail in FIG. 2. This assembly consists of an annular sealed housing 22 which contains an electronic assembly package 24 and an annular weight member 26 which assists in keeping the transducer stable on ascent and descent and reasonably close to vertical in the water despite the existence of lateral forces from the helicopter or currents which may tend to cause the transducer to depart from vertical. The electronic package 24 has connected thereto a plurality of compliant electrical wires 28 from a low frequency hydrophone assembly 30. A base plate or mounting plate 32 forms the floor of the hydrophone chamber and is spaced from the housing 22 by means of a plurality of bars 34 which may be threadedly engaged with housing 22 and plate 32. Mounted on the base 32 is a metal bellows 36 which in FIG. 2 is shown fully collapsed. The hydrophone 30 is further protected by means of a light bag 39 of nylon netting secured to a collar 41 of the electronic housing 24. Bag 39 supports the hydrophone in air while the bellows is removed for servicing, preventing the greater weight of the hydrophone in air from being imposed on the compliant members 38.

Figure 2A:
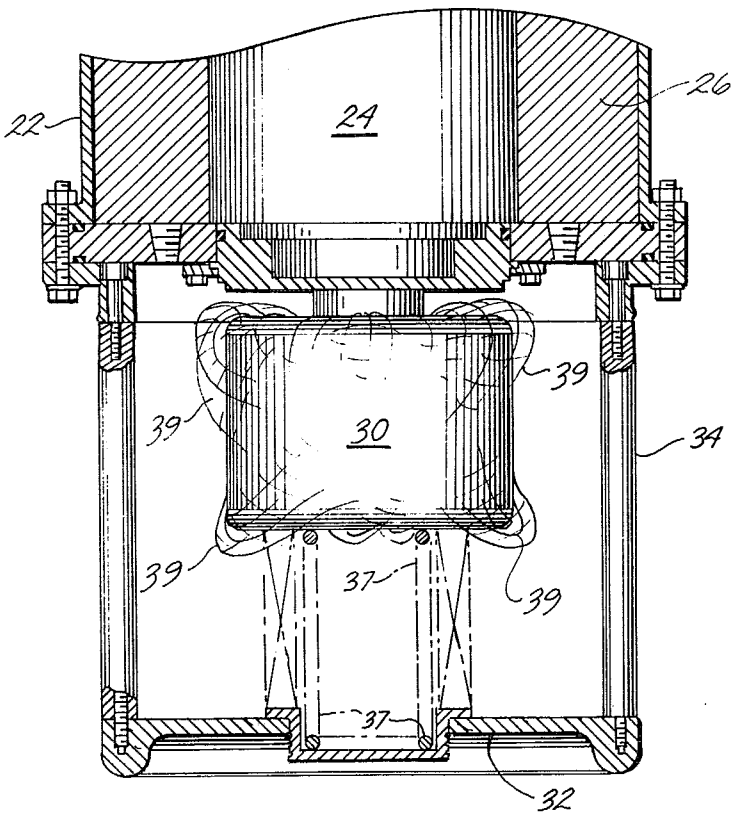
FIG. 2A is a plan view, partially in section, of a portion of the structure of FIG. 2 but with some members shown in alternate positions.

In FIG. 2A the bellows 36, which has an internal spring 37, is shown expanded to the position which it occupies at all times that the transducer assembly is in air. It will be observed that with the bellows expanded, the hydrophone 30 is firmly pressed against the bottom of housing 22 (or, in this case, the electronic housing 24 which forms part of the lower surface of housing 22). This secures the hydrophone irrespective of a reasonable amount of handling of the transducer on the helicopter, or shipboard or in air. When the transducer reaches a significant depth in water, the pressure tends to collapse the bellows, freeing the hydrophone 30 such that it is suspended on a plurality (typically, three) of small rubber suspension member 38 which may be bands, or rods or tubing as shown in FIG. 2. The hydrophone is dimensioned and is of such materials that its weight is substantially less in water than in air and this lighter load can be supported by the compliant members 38 which, however, permit the hydrophone to see a true vertical position irrespective of a tilt of the transducer up to fifteen degrees or somewhat more. This limit is reached when the hydrophone contacts one or more of the rods 34.

Figure 3:
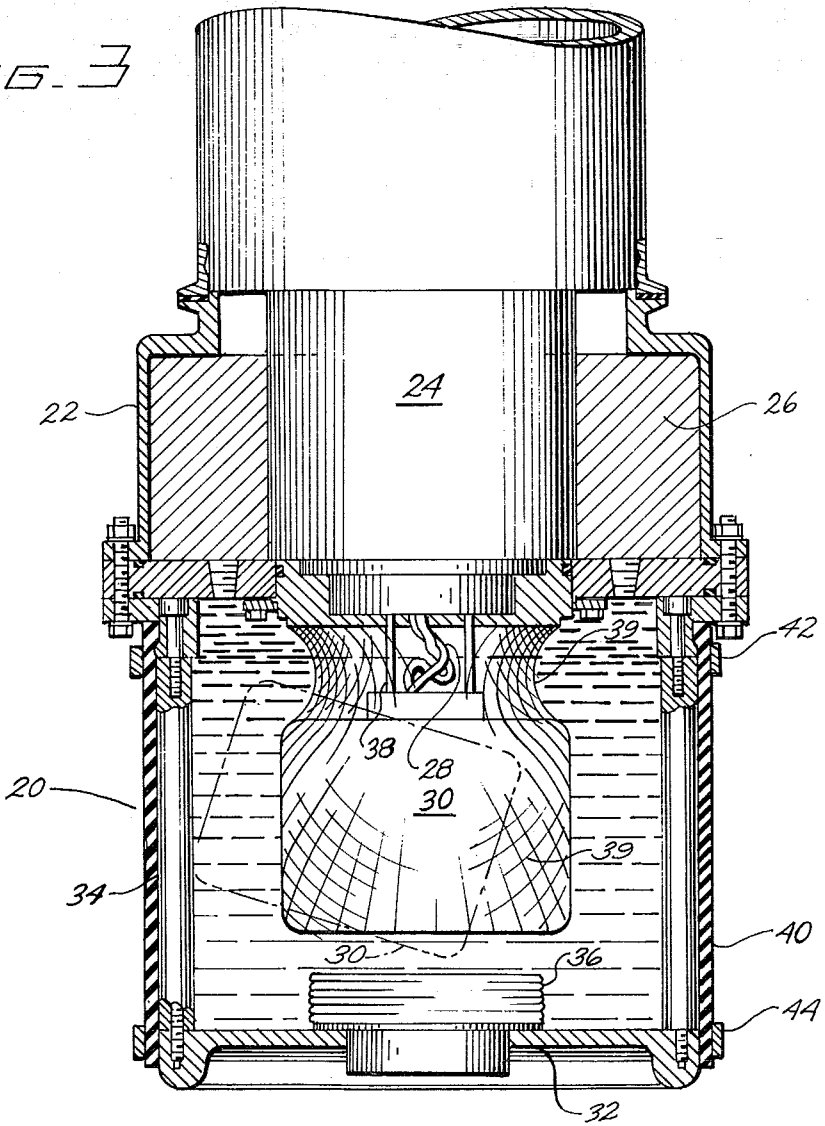
FIG. 3 is an enlarged partial view of the lower part of the assembly of FIG. 1 showing details of a second embodiment of my invention.

A second embodiment of my invention is shown in FIG. 3 which is very similar to the device of FIG. 2 and in which similar or identical parts have been given the same reference numerals. In FIG. 3 the hydrophone 30 and bellows 34 are shown and bellows 34 is mounted on base plate 32 which is spaced from housing 22 by means of rods 34. In FIG. 3, however, a flexible boot 40 of rubber or other elastomeric material is secured to the bottom of housing 22 by means of a conventional clamp 42 and to base plate 32 by means of a similar bond or clamp 44 in such manner that it forms an enclosure for the hydrophone chamber and said chamber is filled with an acoustically transparent liquid such as transformer oil. Operation of the bellows structure is as described above since the pressure of the sea water is conveyed through the boot 40 and the internal oil in essentially the same manner as if the sea water were impinging on the bellows 36 directly.

Considering now the operation of the devices of FIGS. 2 and 2A, it will be recognized that while the transducer 10 is stored or being transported by ship or helicopter, the bellows 36 will be expanded and the hydrophone 30 is secured tightly against the bottom of housing 22. When the transducer is deployed, the hydrophone will remain so secured until a depth is reached at which the bellows collapses sufficiently to permit the hydrophone to be suspended on its rubber supporting members 38. The bellows is normally completely collapsed at a depth of about thirty feet. While the transducer is in the water at or near operating depth, the helicopter hovers over the area but may move laterally an amount sufficient to cause some tilting of the hydrophone. Because of the compliant mounting members 38, the hydrophone 30 will nevertheless seek a true vertical position. Also, the engine or rotor noise which may be carried down the cable into the transducer 10 is largely damped out by the flexible members 38, so that sonar signals of quite small magnitude may be picked up by hydrophone 30 and transmitted up the cable 12 to the processing equipment in the helicopter. Echo ranging may also take place while the transducer is so positioned.

The FIG. 3 structure operates essentially as described above. Since the oil inside the boot 40 is prevented from being displaced more than slightly laterally by the walls of the boot, and since a substantial component of the aircraft noise which is of concern comes down the cable 12 and is translated into a vertical oscillation of the transducer housing, such noise seems to have a slightly greater effect on the hydrophone 30 than where the hydrophone is exposed to sea water directly. This is because the vertical movement imparted to the confined oil in the chamber is translated into a somewhat greater amount of horizontal component and is thus somewhat more capable of affecting the hydrophone 30 which is oriented to receive and respond to horizontally oriented signals. This noise signal from the cable has not proved to be of such magnitude as to substantially degrade performance of the FIG. 3 embodiment, however.

From the foregoing, it will be appreciated that the structure described above adds substantial capability to the basic echo ranging transducer because of the extended listening range which it makes available. The low frequency hydrophone is carried on a very compliant suspension structure while in operation but is firmly secured against damage during handling out of the water and during the transition in and out of the water. Since the compliant members may be overloaded if exposed to the weight of the hydrophone in air, the nylon netting bag supports the weight of the hydrophone in air if and when the bellows assembly is removed for service or during assembly. Once the buoyant effect of the sea water operates to reduce the effective weight of the hydrophone, its weight is removed from the bag and is entirely carried by compliant members 38. The nylon mesh bag is also effective to avoid undesired lateral movement of the hydrophone during those transitional periods when the transducer is in the water, the depth is such that the bellows is partly compressed, thereby freeing the hydrophone, and yet there is some further vertical movement of the transducer assembly. This is particularly important in the free-flooding arrangement of FIGS. 2 and 2A. The bellows-type securing arrangement in combination with the compliant mounting means assures good operation of the hydrophone when suspended and good protection for the hydrophone when being stored, handled, transported or deployed. This secured position is effected without a requirement for electrical release devices with their attendant sealing and insulating problems or manual releases which become quite impractical in this installation because of the difficulty of reaching the assembly or transmitting physical forces to the assembly after deployment. With respect to the FIG. 3 embodiment, those skilled in the art will recognize that the walls of the hydrophone chamber could as well be different from that described in that the rods could be incorporated into the rubber boot or actually consist of thickened rubber posts molded into the boot with other suitable attachment means. Similarly, while the support plate of FIGS. 2 and 2A has been described as spaced from the sealed housing by means of rods, any suitable spacing structure of adequate strength and which permits the hydrophone chamber to be free-flooding will be adequate for this purpose.

We claim:

1. In a sonar system wherein a transducer is suspended into a body of water and returned therefrom, said transducer including an assembly of piezoelectric hydrophones and projector elements, said elements projecting sonar signals and said hydrophone receiving echo signals over a desired high frequency range and wherein a low frequency hydrophone assembly is included, said low frequency hydrophone assembly comprising a sealed housing attached to said assembly including an electronics package a chamber including a support plate and means attaching said support plate to said housing and a bellows fastened to said support plate, a low frequency hydrophone in said chamber having electrical connections to said electronics package and mechanical connectors to said sealed housing, said mechanical connectors including a plurality of compliant suspension members wherein, in air, said bellows is expanded thereby firmly securing said hydrophone between said bellows and said sealed housing and when said bellows is exposed to water pressure at a predetermined depth it is collapsed, leaving said hydrophone suspended in said chamber on said compliant suspension members.

2. A sonar system as set forth in claim 1 wherein said chamber is free-flooding, and said attaching means includes a plurality of rods connecting said support plate to said housing.

3. A sonar system as set forth in claim 1 wherein said means attaching said support plate to said housing includes a flexible boot of elastomeric material, said boot being filled with a substantially acoustically transparent liquid.

4. A sonar system as set forth in claim 3 wherein said means attaching said support plate to said housing includes a plurality of rods extending between said support plate and said housing.

5. A sonar system as set forth in claim 1 wherein the interior of said sealed housing is maintained at substantially sea level pressure irrespective of the depth to which said transducer decends.

6. A sonar system as set forth in claim 1 wherein said compliant suspension members and said attaching means permit said low frequency hydrophone to remain essentially vertically oriented even though said transducer may be over fifteen degrees displaced from the vertical.

7. A sonar system as set forth in claim 1 wherein said hydrophone is positioned within a lightweight bag of netting material fastened to said sealed housing and the dimensions of said bag are such that when said transducer is in air and not secured by said bellows, said bag carries a substantial part of the weight of said hydrophone.

8. In an airborne sonar system wherein a transducer is suspended from a hovering aircraft into a body of water and returned thereto, said transducer including an assembly of piezoelectric hydrophone and projector elements, said elements being designed to project sonar signals and said hydrophones to receive echo signals over a desired frequency range, wherein an additional low frequency listening hydrophone assembly is included, said low frequency hydrophone assembly including:

a sealed housing attached to said assembly including an electronics housing and an annular weight surrounding said electronics housing, a free-flooding chamber including a support plate, a spring-loaded bellows attached to said support plate, and a plurality of rods attaching said support plate to said sealed housing, and a low frequency hydrophone in said chamber having electrical connections to said electronics housing and mechanical suspension means connecting said hydrophone to said electronics housing including a plurality of highly compliant flexible members, wherein said bellows is expanded in air such that said hydrophone is held firmly between said bellows and said sealed housing and when said bellows is exposed to water pressure at a significant depth, it is collapsed, leaving said hydrophone suspended on said compliant flexible members.

* * * * *